US010806678B2

(12) United States Patent
Fujii

(10) Patent No.: US 10,806,678 B2
(45) Date of Patent: Oct. 20, 2020

(54) MEDICINE SUPPLY APPARATUS

(71) Applicant: Takazono Technology Incorporated, Hirakata-shi, Osaka (JP)

(72) Inventor: Takayuki Fujii, Hirakata (JP)

(73) Assignee: Takazono Technology Incorporated, Hirakata-shi, Osaka (JP)

( * ) Notice: Subject to any disclaimer, the term of this patent is extended or adjusted under 35 U.S.C. 154(b) by 163 days.

(21) Appl. No.: 16/083,985

(22) PCT Filed: Jan. 27, 2017

(86) PCT No.: PCT/JP2017/002939
§ 371 (c)(1),
(2) Date: Sep. 11, 2018

(87) PCT Pub. No.: WO2017/159068
PCT Pub. Date: Sep. 21, 2017

(65) Prior Publication Data

US 2020/0146940 A1 May 14, 2020

(30) Foreign Application Priority Data

Mar. 18, 2016 (JP) ..... 2016-055368

(51) Int. Cl.
*B65B 59/04* (2006.01)
*A61J 7/00* (2006.01)

(52) U.S. Cl.
CPC ..... *A61J 7/0084* (2013.01); *B65B 59/04* (2013.01); *A61J 2200/70* (2013.01)

(58) Field of Classification Search
USPC ..... 221/83, 197, 198
See application file for complete search history.

(56) References Cited

U.S. PATENT DOCUMENTS 4,207,992 A * 6/1980 Brown ..... A61J 7/0481 221/15
2005/0122010 A1 6/2005 Kobayashi et al.
(Continued)

FOREIGN PATENT DOCUMENTS

CN 1623528 A 6/2005
CN 101547717 A 9/2009
(Continued)

OTHER PUBLICATIONS

Office Action dated Oct. 15, 2019, issued in counterpart JP application No. 2016-055368, with English translation. (8 pages).
(Continued)

*Primary Examiner* — Gene O Crawford
*Assistant Examiner* — Ayodeji T Ojofeitimi
(74) *Attorney, Agent, or Firm* — Westerman, Hattori, Daniels & Adrian, LLP

(57) ABSTRACT

A medicine supply apparatus capable of suppressing entry of foreign substances into a medicine passage and also capable of reducing time and effort required in an operation of attaching and detaching a medicine container is provided. A container support portion is configured to support a medicine container so as to be attachable and detachable. The container support portion is provided with a medicine passage through which a medicine discharged from the medicine container passes. The container support portion has an opening and closing member. The opening and closing member is movable to: an open position at which the medicine passage is opened; and a close position at which the medicine passage is closed.

6 Claims, 11 Drawing Sheets

(56) References Cited

U.S. PATENT DOCUMENTS

| | | | | |
|---|---|---|---|---|
| 2009/0057328 | A1* | 3/2009 | Ratnakar | G07F 17/0092 221/1 |
| 2010/0043349 | A1 | 2/2010 | Yuyama et al. | |
| 2010/0078445 | A1 | 4/2010 | Nam | |
| 2010/0083963 | A1 | 4/2010 | Wharton et al. | |
| 2011/0315705 | A1* | 12/2011 | Ando | B65D 83/0409 221/9 |
| 2016/0068328 | A1 | 3/2016 | T Lam et al. | |

FOREIGN PATENT DOCUMENTS

| | | | |
|---|---|---|---|
| CN | 202966690 | U | 6/2013 |
| CN | 105247583 | A | 1/2016 |
| EP | 1 473 228 | A1 | 11/2004 |
| JP | 6-40402 | A | 2/1994 |
| JP | 2000-219201 | A | 8/2000 |
| JP | 2004-115105 | A | 4/2004 |
| JP | 2006-158606 | A | 6/2006 |
| JP | 2008-62945 | A | 3/2008 |
| JP | 4884648 | B2 | 2/2012 |

OTHER PUBLICATIONS

International Search Report dated Apr. 4, 2017, issued in counterpart International Application No. PCT/JP2017/002939 (2 pages).
Office Action dated Jun. 24, 2020, issued in counterpart Chinese Patent Application No. 201780018051.9 (w/ English machine translation, 14 pages).

* cited by examiner

MEDICINE SUPPLY APPARATUS

TECHNICAL FIELD

The present invention relates to a medicine supply apparatus, and particularly to a medicine supply apparatus configured to supply a tablet.

BACKGROUND ART

Conventionally, a medicine supply apparatus has been proposed, which is formed of a case support table and a tablet containing case attachable to and detachable from the case support table, in which the case support table is provided with a discharge passage, through which the tablet dispensed from the tablet containing case attached to the case support table passes (for example, see Japanese Patent No. 4884648 (PTD 1)).

CITATION LIST

Patent Document

PTD 1: Japanese Patent No. 4884648

SUMMARY OF INVENTION

Technical Problem

In the apparatus disclosed in the above-mentioned patent document, the inlet of the discharge passage is opened in the state where the tablet containing case is detached from the case support table. Accordingly, entry of foreign substances into the discharge passage may occur. In order to prevent entry of such foreign substances into the discharge passage, it is conceivable to cover the inlet of the discharge passage by a cover member. However, in this case, the operator who handles the medicine supply apparatus needs to attach the cover member each time the tablet containing case is detached from the case support table, and to detach the cover member before the tablet containing case is again attached to the case support table. This complicates the operation of attaching and detaching the tablet containing case.

An object of the present invention is to provide a medicine supply apparatus capable of suppressing entry of foreign substances into a medicine passage and also capable of reducing the time and effort required in the operation of attaching and detaching a medicine container.

Solution to Problem

A medicine supply apparatus according to the present invention includes: a medicine container configured to contain a medicine; and a container support portion configured to support the medicine container so as to be attachable and detachable. The container support portion is provided with a medicine passage through which the medicine discharged from the medicine container passes. The container support portion includes an opening and closing member that is movable to an open position at which the medicine passage is opened and a close position at which the medicine passage is closed.

In the above-described medicine supply apparatus, the medicine container to be attached to the container support portion is configured to move the opening and closing member from the close position to the open position.

In the above-described medicine supply apparatus, the medicine container has a pressing portion. The opening and closing member has a portion to be pressed. When the medicine container is attached to the container support portion, the portion to be pressed comes in contact with the pressing portion and receives a force in a direction from the close position to the open position.

In the above-described medicine supply apparatus, as the medicine container is detached from the container support portion, the opening and closing member moves from the open position to the close position.

The above-described medicine supply apparatus further includes a biasing portion configured to exert a biasing force upon the opening and closing member so as to move the opening and closing member in a direction from the open position to the close position.

In the above-described medicine supply apparatus, a direction in which the medicine container is attached to and detached from the container support portion is in parallel to a direction in which the opening and closing member moves between the open position and the close position.

The above-described medicine supply apparatus further includes a detection portion configured to optically detect the medicine that passes through the medicine passage. The opening and closing member is opaque.

Advantageous Effects of Invention

According to the medicine supply apparatus of the present invention, entry of foreign substances into a medicine passage can be suppressed, and also, the time and effort required in the operation of attaching and detaching a medicine container can be reduced.

DESCRIPTION OF EMBODIMENTS

Figure 1:
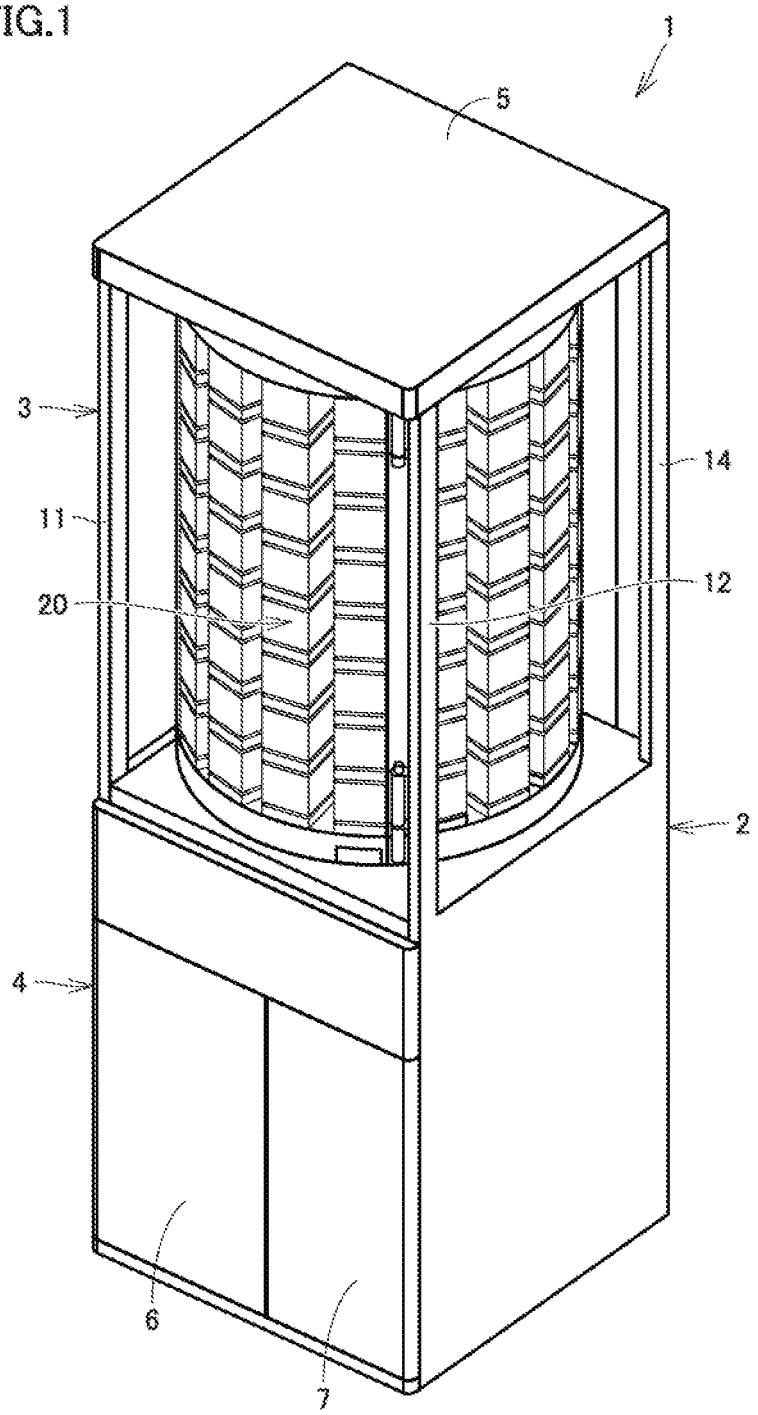
FIG. 1 is a perspective view showing the entire configuration of a medicine supply apparatus.

The embodiments of the present invention will be hereinafter described with reference to the accompanying drawings. In the accompanying drawings, the same or corresponding components are designated by the same reference characters, and description thereof will not be repeated.

First Embodiment

FIG. 1 is a perspective view showing the entire configuration of a medicine supply apparatus 1. As shown in FIG. 1, medicine supply apparatus 1 in the present embodiment includes a housing 2 forming an outer shape of the apparatus. Housing 2 has an upper housing 3 and a lower housing 4. Upper housing 3 is disposed above lower housing 4. Lower housing 4 is disposed below upper housing 3.

A ceiling portion 5 is provided at the uppermost part of housing 2. Ceiling portion 5 has a rectangular shape in plan view. A left front pillar portion 11, a right front pillar portion 12, a left rear pillar portion 13 (not shown in FIG. 1) and a right rear pillar portion 14 are provided at four corners of upper housing 3 seen in plan view. The upper ends of left front pillar portion 11, right front pillar portion 12, left rear pillar portion 13, and right rear pillar portion 14 each are coupled to ceiling portion 5. Ceiling portion 5 is supported by left front pillar portion 11, right front pillar portion 12, left rear pillar portion 13, and right rear pillar portion 14.

A drum 20 having an approximately cylindrical outer shape is disposed inside upper housing 3. The detailed configuration of drum 20 will be described later. Upper housing 3 is in fact provided with a cover for covering the side surfaces on four sides. However, FIG. 1 and the figures described later fail to show the cover for the purpose of more clearly illustrating drum 20. The cover on the front side of upper housing 3 is configured to be openable and closable.

Lower housing 4 has a front surface provided with opening/closing doors 6 and 7. Opening/closing doors 6 and 7 are configured to be openable and closable. An operator who uses medicine supply apparatus 1 can open opening/closing doors 6 and 7 to take out the medicine dispensed in medicine wrapping paper or a vial from inside lower housing 4. Opening/closing doors 6 and 7 may be provided with an opening. Thus, the medicine dispensed in medicine wrapping paper or a vial may be able to be taken out through this opening.

Figure 2:
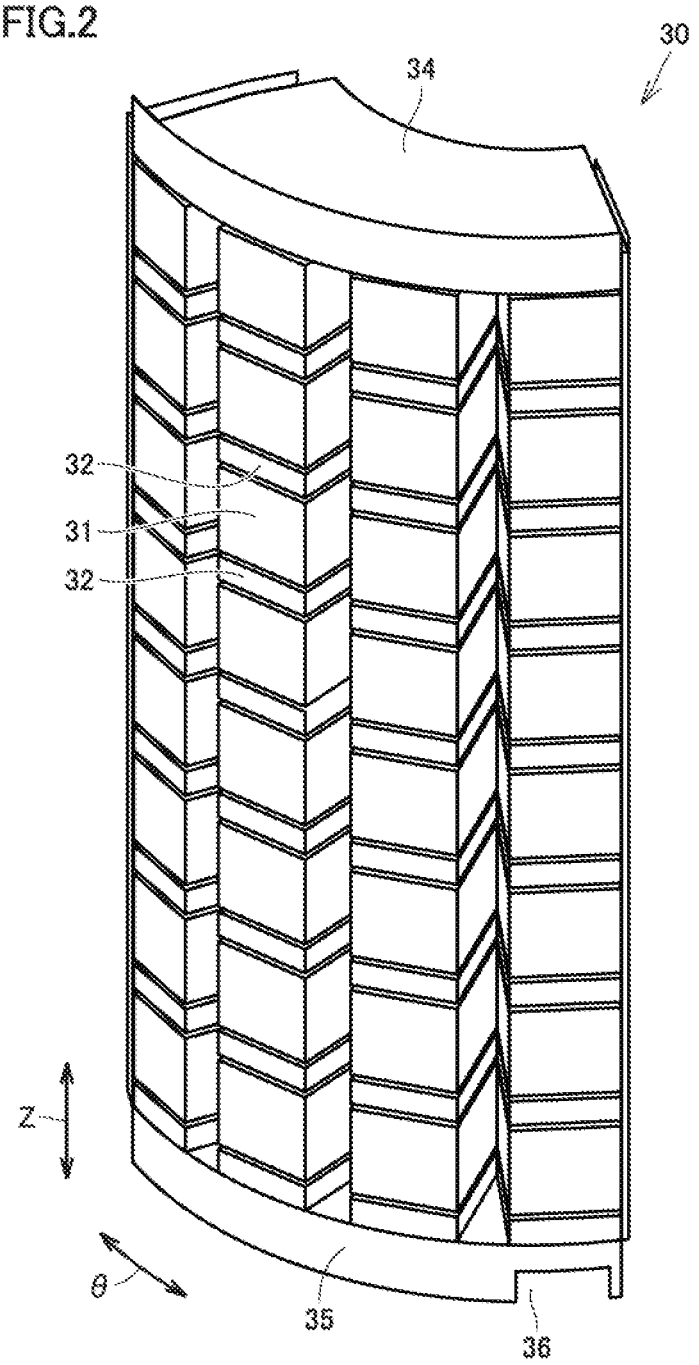
FIG. 2 is a perspective view showing the configuration of an arc-shaped divided body.

FIG. 2 is a perspective view showing the configuration of an arc-shaped divided body 30. Arc-shaped divided body 30 shown in FIG. 2 is obtained by dividing drum 20 having an approximately cylindrical shape shown in FIG. 1 in the circumferential direction. Arc-shaped divided body 30 has an approximate outer shape that is obtained by equally dividing a hollow cylinder in the circumferential direction. A plurality of arc-shaped divided bodies 30 are assembled to form drum 20 shown in FIG. 1. Drum 20 shown in FIG. 1 is a hollow cylindrical body that is formed by combining arc-shaped divided bodies 30.

Arc-shaped divided body 30 shown in FIG. 2 has a plurality of medicine containers 31 and the same number of container support portions 32 as medicine containers 31. Each medicine container 31 is a hollow container. Medicine container 31 has a cover portion that can be opened and closed. Medicine container 31 has an internal space, in which a medicine is contained. The cover portion is opened, so that the medicine is received and accommodated in medicine container 31. The dosage form of the medicine contained in medicine container 31 in the present embodiment is a tablet. Medicine supply apparatus 1 in the present embodiment serves as an apparatus for supplying one type of packaged tablets or a plurality of types of packaged tablets.

Container support portions 32 are arranged to be spaced apart from each other. Medicine container 31 is attached between upper and lower container support portions 32. Each container support portion 32 supports medicine container 31 so as to be attachable and detachable. Each medicine container 31 is provided as a cassette so as to be attachable to and detachable from medicine supply apparatus 1.

Arc-shaped divided body 30 has an upper end portion provided with a ceiling portion 34 having a shape obtained by dividing an annular plate in the circumferential direction. Arc-shaped divided body 30 has a lower end portion provided with an outer sheath plate 35 having a shape obtained by dividing a thin-walled cylinder in the circumferential direction. A part of outer sheath plate 35 is cut out to thereby form a hole portion 36. Hole portion 36 is formed such that the operator who uses medicine supply apparatus 1 can insert his/her fingers therethrough.

Figure 3:
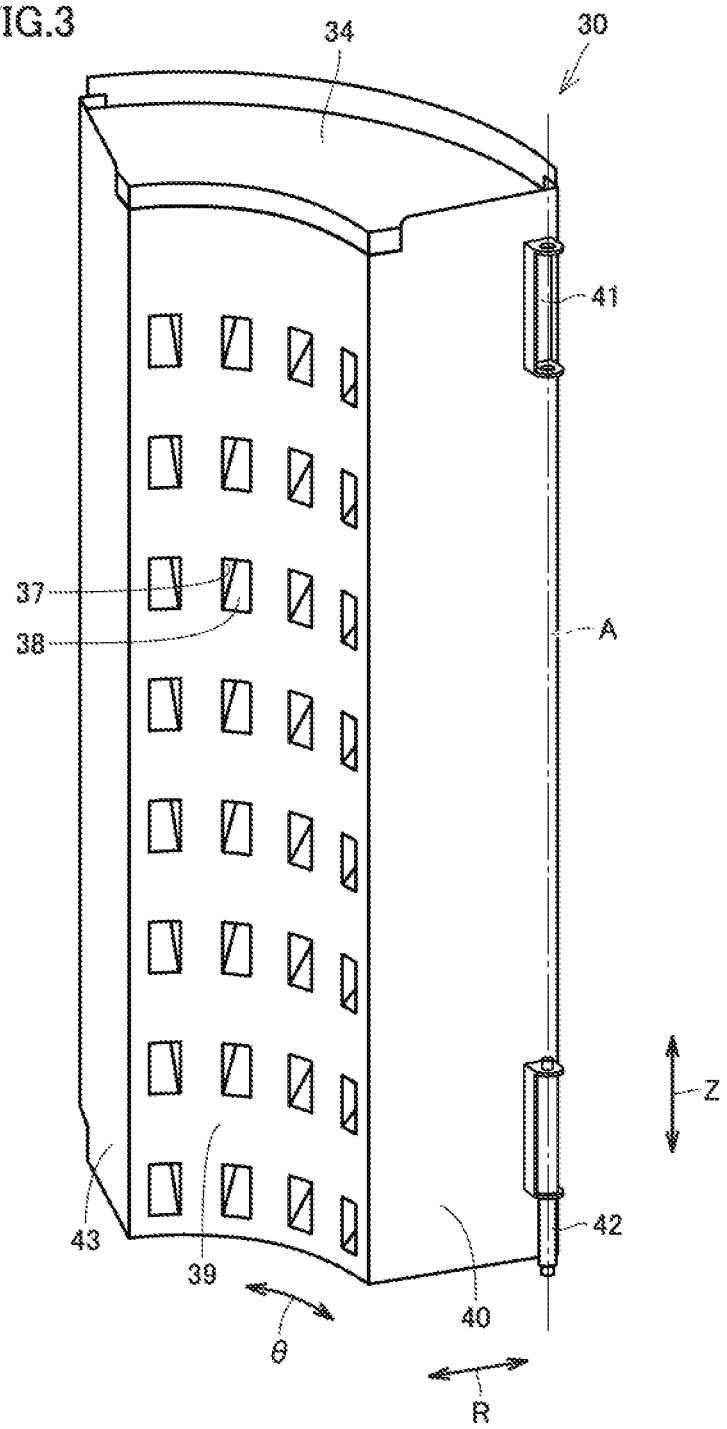
FIG. 3 is a perspective view of the arc-shaped divided body seen at an angle different from that in FIG. 2.

FIG. 3 is a perspective view of arc-shaped divided body 30 seen at an angle different from that in FIG. 2. As shown in FIG. 3, arc-shaped divided body 30 has an inner circumferential surface 39. Inner circumferential surface 39 is one surface of outer surfaces of arc-shaped divided body 30 obtained by dividing a hollow cylinder in the circumferential direction, this one surface being located to face the center line of the hollow cylinder. Inner circumferential surface 39 has a shape obtained by dividing a cylindrical surface in the circumferential direction. Inner circumferential surface 39 has a shape formed of a part of the cylindrical surface. Inner circumferential surface 39 has a partially cylindrical surface shape.

An axial direction Z shown in each of FIG. 3 and other figures indicates the axial direction of the partially cylindrical surface that forms inner circumferential surface 39. A radial direction R shown in each of FIG. 3 and other figures indicates the radial direction of the partially cylindrical surface that forms inner circumferential surface 39. A circumferential direction θ shown in each of FIG. 3 and other figures indicates the circumferential direction of the partially cylindrical surface that forms inner circumferential surface 39.

Arc-shaped divided body 30 is provided with a plurality of radial passages 37 extending in radial direction R. An inclined surface 38 inclined with respect to axial direction Z is provided inside each radial passage 37. Inclined surface 38 forms a bottom surface inside radial passage 37. Each radial passage 37 is opened at inner circumferential surface 39 of arc-shaped divided body 30. Furthermore, radial passage 37 is connected to the internal space of medicine container 31 shown in FIG. 1. Radial passage 37 allows communication between each of medicine containers 31 and inner circumferential surface 39.

As shown in FIG. 3, radial passages 37 are arranged in axial direction Z and also arranged in circumferential direction θ. As shown in FIG. 2, medicine containers 31 are arranged in axial direction Z and also arranged in circumferential direction θ. Each medicine container 31 and each radial passage 37 are arranged side by side in axial direction Z and in circumferential direction θ. Arc-shaped divided body 30 includes a plurality of rows of medicine containers 31 that are arranged side by side in axial direction Z. The plurality of rows of medicine containers 31 are arranged in circumferential direction θ. Each medicine container 31 is arranged to face the outer circumferential surface of arc-shaped divided body 30. Medicine container 31 is provided to be movable in radial direction R. Each container support portion 32 has a portion extending in radial direction R.

Arc-shaped divided body 30 has a first side surface 40 and a second side surface 43. First side surface 40 and second side surface 43 each have a flat plane shape. First side surface 40 and second side surface 43 extend in axial direction Z from the lower end to the upper end of arc-shaped divided body 30, and also extend in radial direction R from inner circumferential surface 39 to the outer circumferential surface of arc-shaped divided body 30.

An upper shaft support portion 41 is fixed to first side surface 40 of arc-shaped divided body 30. Upper shaft support portion 41 is provided with two through hole portions. These two through hole portions are provided to be spaced apart from each other in axial direction Z. Two through hole portions are formed circularly and have a common center in plan view. Upper shaft support portion 41 is provided so as to receive an upper pivot shaft portion (not shown) and to be rotatable with respect to the upper pivot shaft portion. This upper pivot shaft portion is attached to the framework of drum 20.

Furthermore, a lower pivot shaft portion 42 is attached to first side surface 40 of arc-shaped divided body 30. A lower shaft support portion is fixed to first side surface 40, and is provided with two through hole portions similar to those in upper shaft support portion 41. Lower pivot shaft portion 42 penetrates through the through hole portion provided in the lower shaft support portion. Lower pivot shaft portion 42 extends beyond and below the lower end of first side surface 40. Lower pivot shaft portion 42 engages with the framework of drum 20.

A rotation axis A shown by an alternate long and short dash line in FIG. 3 is an imaginary straight line extending in axial direction Z. Rotation axis A passes through the center of each of two through hole portions provided in upper shaft support portion 41 and extends through the axis line of lower pivot shaft portion 42. Rotation axis A acts as the center of rotation of arc-shaped divided body 30. Arc-shaped divided body 30 is pivotable about rotation axis A.

Figure 4:
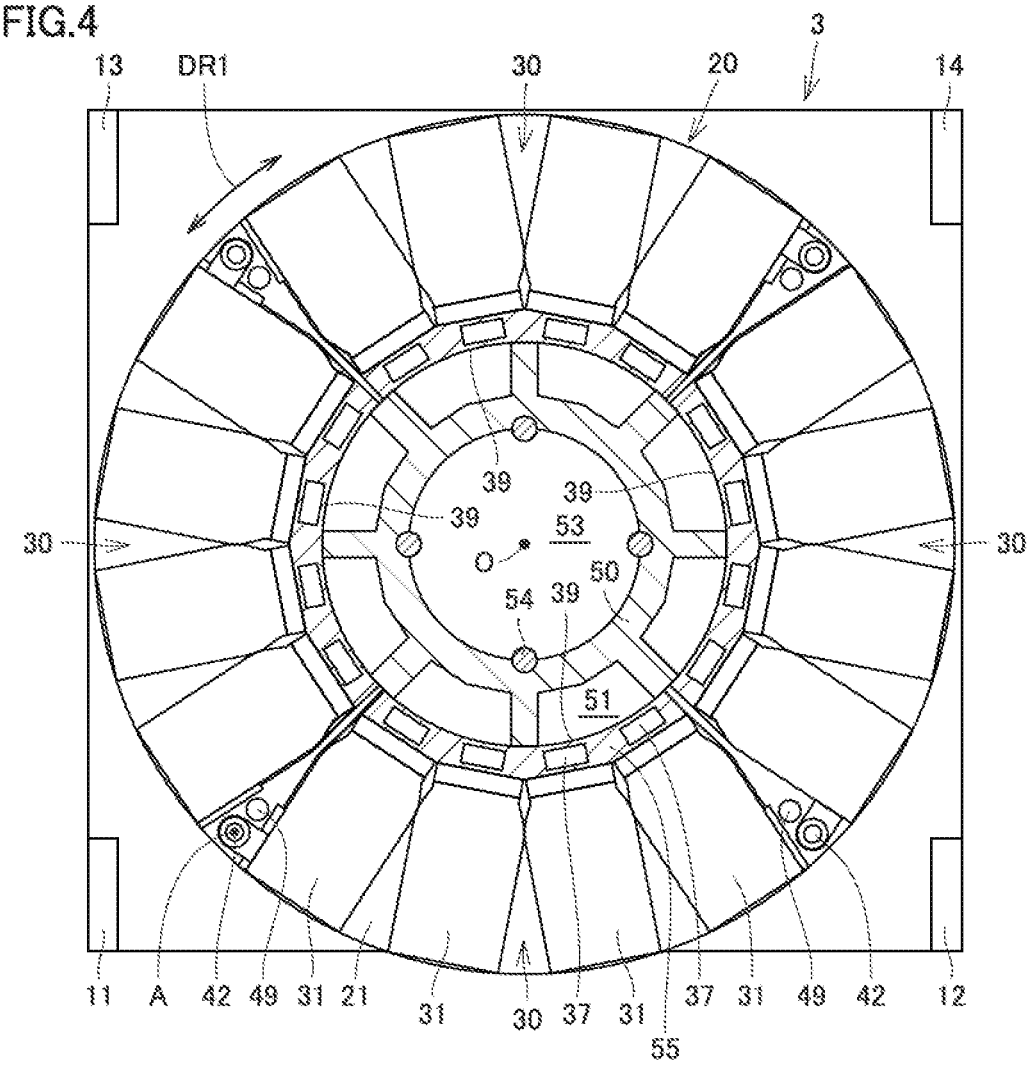
FIG. 4 is a partial cross-sectional view of the medicine supply apparatus.

FIG. 4 is a partial cross-sectional view of medicine supply apparatus 1. The partial cross-sectional view shown in FIG. 4 shows a lower cut surface obtained by cutting medicine supply apparatus 1 shown in FIG. 1 along the plane extending in the horizontal direction and passing through drum 20. As shown in FIG. 4, left front pillar portion 11, right front pillar portion 12, left rear pillar portion 13, and right rear pillar portion 14 are provided at four corners of upper housing 3 seen in plan view.

Drum 20 includes four arc-shaped divided bodies 30. Four arc-shaped divided bodies 30 as shown in FIGS. 2 and 3 are arranged side by side such that their inner circumferential surfaces 39 extend in a cylindrical shape, thereby forming an approximately cylindrical-shaped drum 20 shown in FIG. 4. Arc-shaped divided bodies 30 are obtained by dividing approximately cylindrical-shaped drum 20 into four parts in the circumferential direction. Each arc-shaped divided body 30 includes a plurality of medicine containers 31 arranged in four rows in circumferential direction θ.

A center line O shown in FIG. 4 shows the center line of partially cylindrical surface-shaped inner circumferential surfaces 39 of arc-shaped divided bodies 30 arranged side by side as shown in FIG. 4. Center line O also shows the center line of approximately cylindrical-shaped drum 20. Center line O extends in the direction perpendicular to the surface of the sheet of paper showing FIG. 4. Rotation axis A shown in each of FIGS. 3 and 4 is located to be spaced apart from center line O and extends in parallel with center line O. Rotation axis A is provided in the vicinity of the outer circumferential edge of drum 20. Rotation axis A extends in the direction perpendicular to the surface of the sheet of paper showing FIG. 4. Axial direction Z shown in each of FIGS. 2 and 3 corresponds to the direction perpendicular to the surface of the sheet of paper showing FIG. 4.

Radial passage 37 described above is formed in the vicinity of center line O of drum 20 relative to medicine container 31. Radial passage 37 is formed in an inner circumferential portion 55 of each arc-shaped divided body 30. The surface on the radially inside of inner circumferential portion 55 corresponds to inner circumferential surface 39 described above.

The plurality of arc-shaped divided bodies 30 are arranged in the circumferential direction about center line O to thereby form a hollow cylindrical shape. The plurality of arc-shaped divided bodies 30 are integrally pivotable about center line O as in a pivot direction DR1 indicated by a double-headed arrow in FIG. 4. The plurality of arc-shaped divided bodies 30 are provided so as to be rotatable with respect to upper housing 3, and configured to be movable sequentially one by one to the front surface side of medicine supply apparatus 1. The lower side in FIG. 4 corresponds to the front surface side of medicine supply apparatus 1.

A support pillar 50 forming a part of the framework of drum 20 is disposed in the vicinity of center line O relative to arc-shaped divided body 30. Support pillar 50 extends along center line O in the direction perpendicular to the surface of the sheet of paper showing FIG. 4. Support pillar 50 is formed to be hollow. A hollow space 53 is formed inside support pillar 50. Four structural pillars 54 are disposed on the inner circumferential surface of support pillar 50 that faces hollow space 53. Each structural pillar 54 has a solid cylindrical pillar shape extending in the direction perpendicular to the surface of the sheet of paper showing FIG. 4.

Support pillar 50 has an outer circumferential surface provided with a plurality of groove shapes extending in the direction perpendicular to the surface of the sheet of paper showing FIG. 4. Each of these groove shapes forms an axial passage 51 extending in axial direction Z. The plurality of groove shapes form a plurality of axial passages 51. The plurality of axial passages 51 extend in parallel to each other. Inner circumferential surface 39 of arc-shaped divided body 30 faces axial passage 51. Inner circumferential surface 39 of arc-shaped divided body 30 forms a part of the wall surface of axial passage 51. Inner circumferential surface 39 forms the wall surface on the outer circumferential side of axial passage 51.

Axial passage 51 is formed inward in radial direction R with respect to arc-shaped divided body 30. Medicine container 31 is disposed to face the front surface of medicine supply apparatus 1. Axial passage 51 is formed in the area closer to the inner side of medicine supply apparatus 1 with respect to medicine container 31.

As shown in FIG. 4, in the present embodiment, the outer circumferential surface of support pillar 50 is provided with axial passages 51 at eight positions in the circumferential direction. Eight axial passages 51 are arranged in circumferential direction θ. Two axial passages 51 are provided for one arc-shaped divided body 30. One axial passage 51 is provided for two rows of medicine containers 31 arranged in circumferential direction θ. One axial passage 51 is provided for two radial passages 37. Radial passage 37 communicates with axial passage 51. Medicine container 31 and axial passage 51 communicate with each other through radial passage 37.

A reinforcing stay 49 is disposed in the vicinity of center line O relative to each lower pivot shaft portion 42. In the present embodiment, drum 20 has four arc-shaped divided bodies 30 and four lower pivot shaft portions 42. Accordingly, reinforcing stays 49 are also provided at four positions. Each reinforcing stay 49 extends in the direction perpendicular to the surface of the sheet of paper showing FIG. 4. Reinforcing stay 49 extends in the up-down direction from the vicinity of the lower end of upper housing 3 to the vicinity of the upper end thereof. Drum 20 includes a bottom plate 21 having an annular flat plate shape and a ceiling plate (not shown) having the same shape as bottom plate 21. Reinforcing stay 49 has a lower end fixed to bottom plate 21. Reinforcing stay 49 has an upper end fixed to the ceiling plate.

Figure 5:
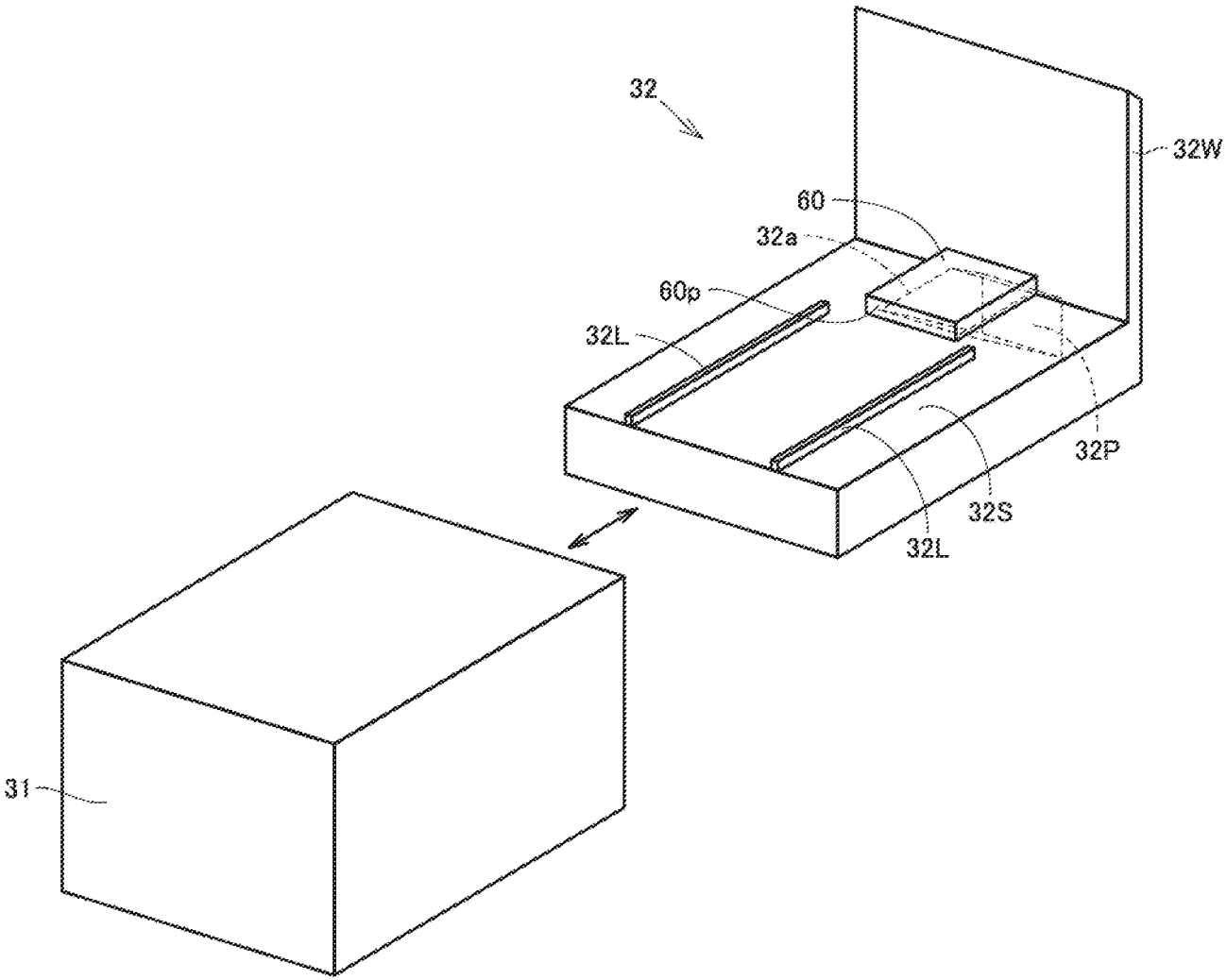
FIG. 5 is an exploded perspective view of a medicine container and a container support portion.

FIG. 5 is an exploded perspective view of medicine container 31 and container support portion 32. In FIG. 5, medicine container 31 is schematically shown in a rectangular box shape. Medicine container 31 may be detached from container support portion 32 for the purpose of replenishment of medicines into medicine container 31, replacement with another medicine container containing other types of medicines, and the like.

As shown in FIG. 5, container support portion 32 has a support surface 32S on which medicine container 31 is mounted. In the state where medicine container 31 is attached to container support portion 32, medicine container 31 is mounted on support surface 32S and supported thereon.

A pair of rails 32L is provided on support surface 32S. In the arrangement where arc-shaped divided bodies 30 are disposed in circumferential direction θ to form cylindrical drum 20 as shown in FIG. 4, each rail 32L extends in radial direction R. On the lower surface of medicine container 31, an engagement portion configured to engage with rail 32L is formed. Medicine container 31 moves along rail 32L in radial direction R such that medicine container 31 is attached to container support portion 32 or detached from container support portion 32.

A lock mechanism is provided between medicine container 31 and container support portion 32. The lock mechanism is configured to lock medicine container 31 in the state where this medicine container 31 is attached to container support portion 32. Medicine container 31 is provided with an operation portion for releasing the locking by the lock mechanism. The lock mechanism and the operation portion are not shown. When medicine container 31 is attached to container support portion 32, medicine container 31 is locked onto container support portion 32 by the lock mechanism. When the operation portion is operated, the locked state by the lock mechanism is released, so that medicine container 31 can be detached from container support portion 32.

Container support portion 32 has a rear wall 32W. Rear wall 32W extends approximately perpendicular to support surface 32S. Rear wall 32W is disposed adjacent to inner circumferential portion 55 of arc-shaped divided body 30 shown in FIG. 4.

A medicine passage 32P is formed in container support portion 32. Medicine passage 32P serves as a passage through which the medicine discharged from medicine container 31 attached to container support portion 32 passes. In the present embodiment, medicine passage 32P forms the entire radial passage 37. Medicine passage 32P may form a part of radial passage 37. Specifically, medicine passage 32P may form a part of radial passage 37 that includes an end opposite to the end contiguous to axial passage 51. Medicine passage 32P is provided with an inlet opening 32*a*. Inlet opening 32*a* is formed in support surface 32S. Medicine passage 32P extends through and beyond rear wall 32W in the direction in which medicine container 31 is attached to and detached from container support portion 32 or in the direction in which rail 32L extends.

Container support portion 32 has an opening and closing member 60. Opening and closing member 60 has a rectangular flat-plate shape in a plan view. Opening and closing member 60 is a resin molded product, for example. Opening and closing member 60 is formed of an opaque material. Opening and closing member 60 is movable to the open position at which inlet opening 32*a* of medicine passage 32P is opened and the close position at which inlet opening 32*a* of medicine passage 32P is closed. Opening and closing member 60 has a portion to be pressed 60*p*. Portion to be pressed 60*p* corresponds to a part of the outer surface of opening and closing member 60, which comes in contact with medicine container 31 and receives a force from medicine container 31, as will be described later.

Figure 6:
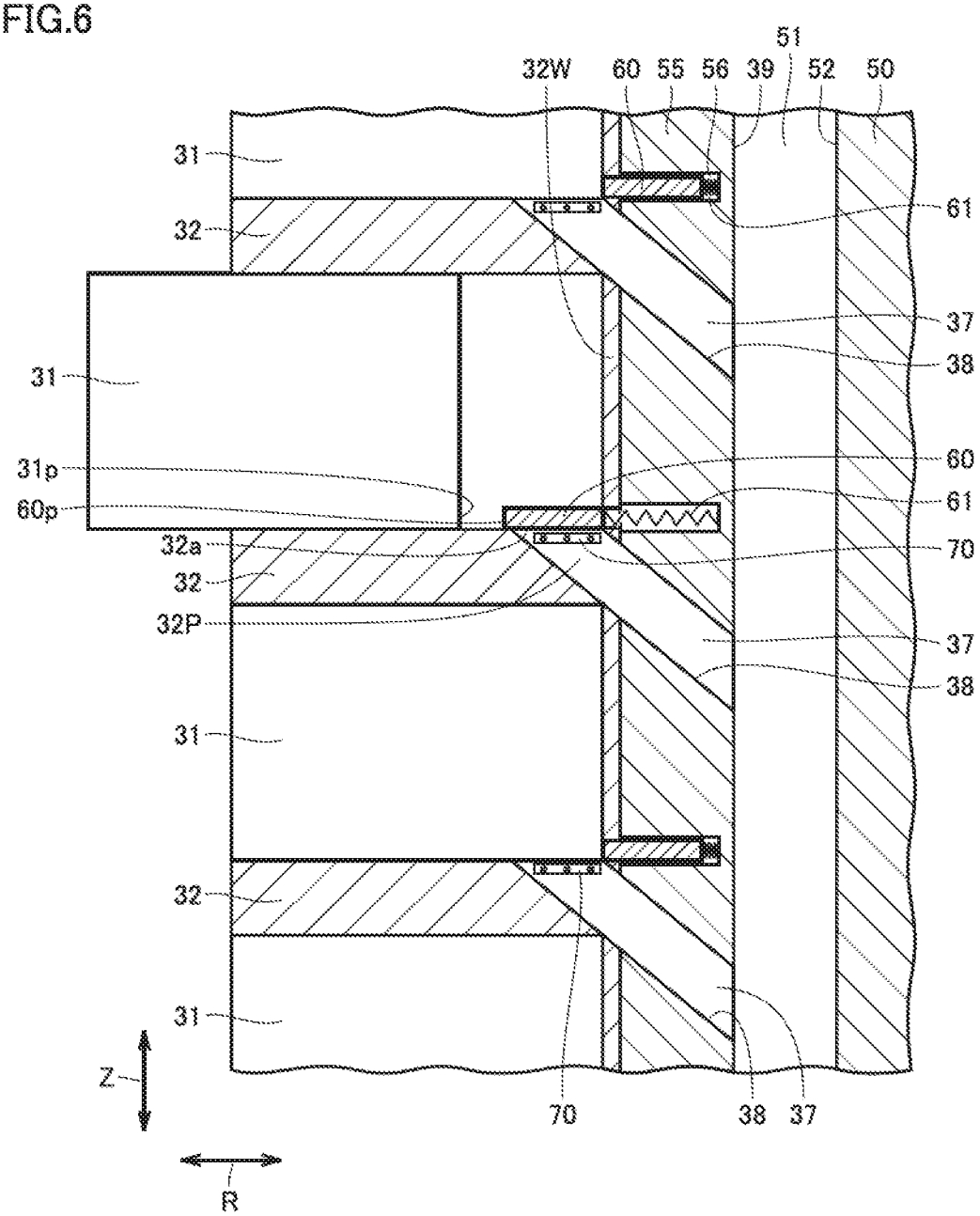
FIG. 6 is the first partial cross-sectional view showing the state where the medicine container is attached to the container support portion.

FIG. 6 is the first partial cross-sectional view showing the state where medicine container 31 is attached to container support portion 32. FIG. 6 shows only some of the plurality of medicine containers 31 and some of the plurality of container support portions 32 that are included in medicine supply apparatus 1. The plurality of container support portions 32 are arranged side by side in axial direction Z.

Radial passage 37 has an inclined surface 38. Radial passage 37 communicates with axial passage 51. Inner circumferential surface 39 of inner circumferential portion 55 in arc-shaped divided body 30 faces axial passage 51, and forms a part of the wall surface of axial passage 51. As shown in FIG. 6, an opposed surface 52 facing inner circumferential surface 39 forms a part of the wall surface of axial passage 51. Inner circumferential surface 39 and opposed surface 52 extend in axial direction Z so as to be formed approximately in parallel to each other.

In inner circumferential portion 55 of arc-shaped divided body 30, a hollow accommodating portion 56 is formed. In the state where medicine container 31 is attached to container support portion 32, opening and closing member 60 and biasing portion 61 are accommodated in accommodating portion 56. Among three opening and closing members 60 shown in FIG. 6, the most part of each of two opening and closing members 60 shown on the upper side and the lower side in the figure is disposed inside accommodating portion 56. Among three opening and closing members 60 shown in FIG. 6, one opening and closing member 60 shown in the intermediate portion is disposed outside accommodating portion 56.

In radial direction R, rear wall 32W of container support portion 32 is arranged to be spaced apart from inner circumferential surface 39 of arc-shaped divided body 30. Accommodating portion 56 is formed by utilizing this space between rear wall 32W and inner circumferential surface 39. In place of the illustrated example in which accommodating portion 56 is formed in arc-shaped divided body 30, a part of rear wall 32W may protrude toward inner circumferential surface 39 to thereby form an accommodating space in which opening and closing member 60 can be accommodated.

Opening and closing member 60 of container support portion 32 to which medicine container 31 is attached is accommodated in accommodating portion 56. Opening and closing member 60 of container support portion 32 to which medicine container 31 is not attached is not accommodated in accommodating portion 56 and located at the position where medicine container 31 attached to container support portion 32 should be positioned. Opening and closing member 60 protruding to the outside of accommodating portion 56 shown in FIG. 6 covers inlet opening 32*a* of medicine passage 32P. Opening and closing member 60 accommodated in accommodating portion 56 shown in FIG. 6 is positioned to open inlet opening 32*a* of medicine passage 32P. Opening and closing member 60 is provided so as to be movable to the open position at which medicine passage 32P is opened and the close position at which medicine passage 32P is closed. Opening and closing member 60 shown in FIG. 5 is located at the close position.

Figure 7:
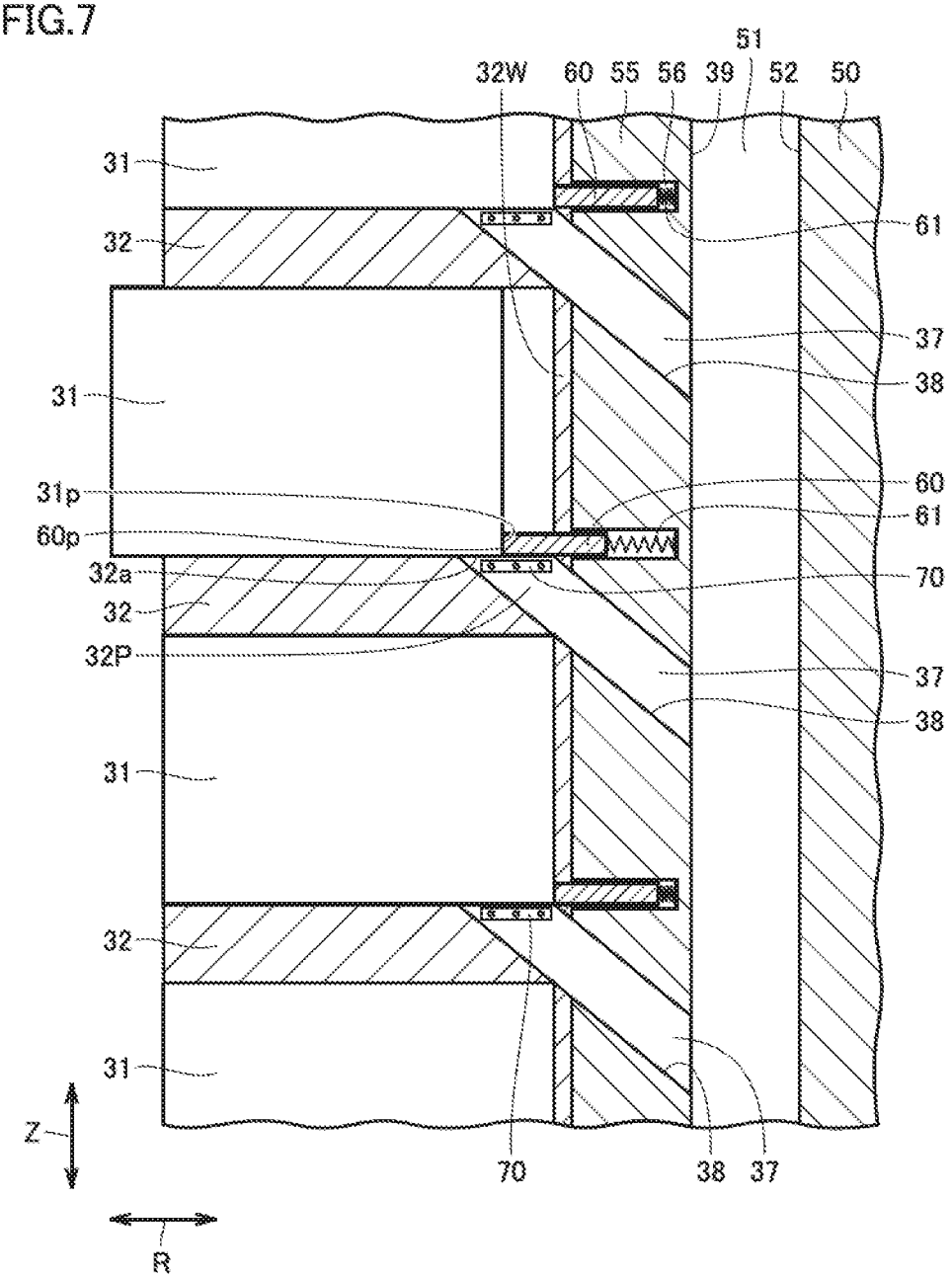
FIG. 7 is the second partial cross-sectional view showing the state where the medicine container is attached to the container support portion.
Figure 8:
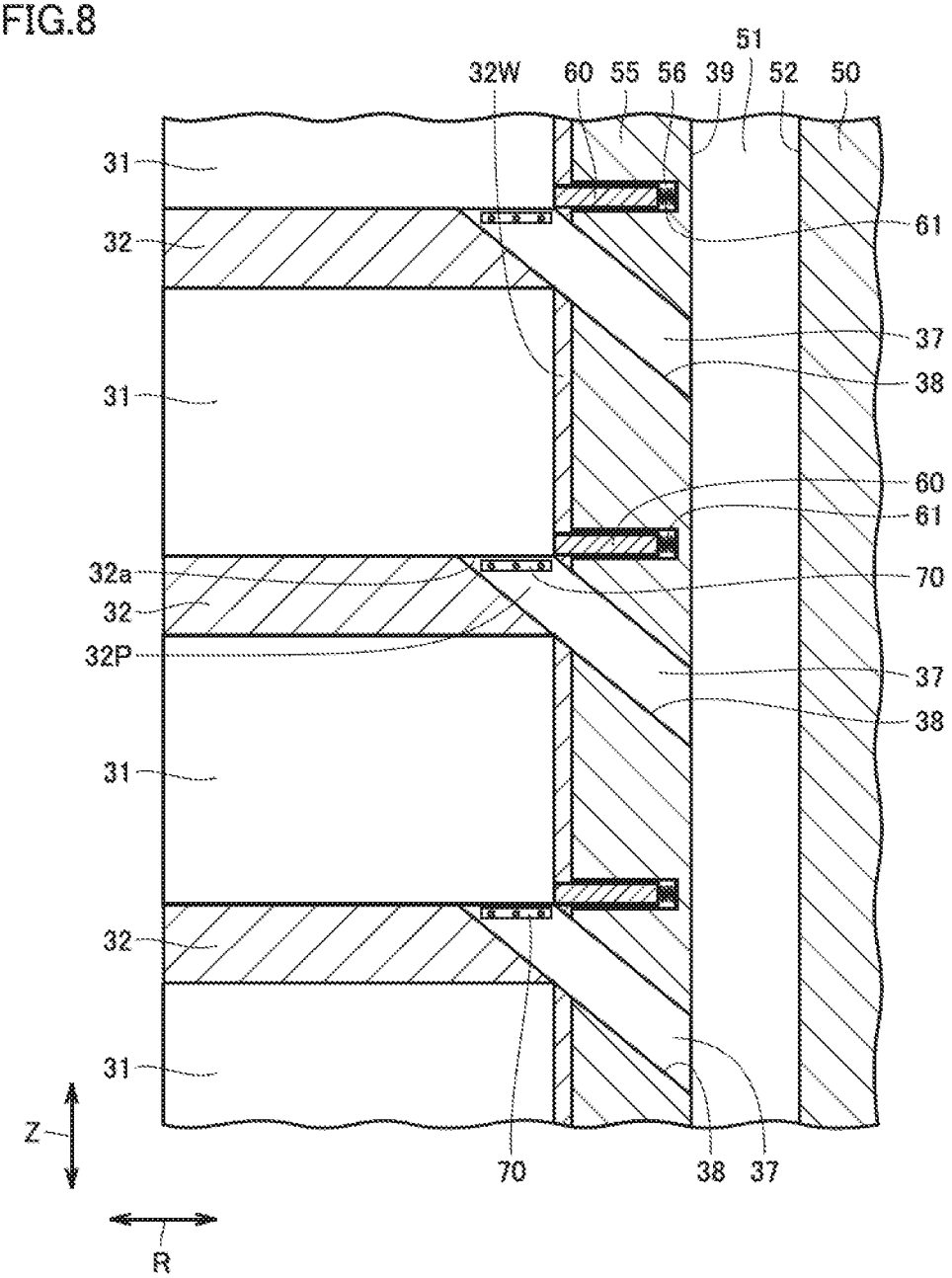
FIG. 8 is the third partial cross-sectional view showing the state where the medicine container is attached to the container support portion.

FIG. 6 and FIGS. 7 and 8 (described later) each show the state where medicine container 31 is attached to container support portion 32 at the second from the top in the figure. Rear wall 32W is disposed adjacent to inner circumferential portion 55 of arc-shaped divided body 30. FIG. 6 shows medicine container 31 that is in the middle of movement toward rear wall 32W along rail 32L (FIG. 5). Medicine container 31 has a pressing portion 31*p*. In FIG. 6, pressing portion 31*p* of medicine container 31 is located spaced apart from portion to be pressed 60*p* of opening and closing member 60. Accordingly, in FIG. 6, medicine container 31 does not exert a force on opening and closing member 60.

FIG. 7 is the second partial cross-sectional view showing the state where medicine container 31 is attached to container support portion 32. Medicine container 31 shown in FIG. 7 is moved in radial direction R to the position closer to rear wall 32W of container support portion 32 as compared with FIG. 6. Pressing portion 31*p* of medicine container 31 comes in contact with portion to be pressed 60*p* of opening and closing member 60. Medicine container 31 pushes opening and closing member 60 into the inside of accommodating portion 56. From medicine container 31, opening and closing member 60 receives the force exerted in the direction toward the inside of accommodating portion 56 along radial direction R. Opening and closing member 60 shown in FIG. 7 is disposed so as to penetrate through rear wall 32W of container support portion 32. In this case, opening and closing member 60 is partially located inside accommodating portion 56 and partially located outside accommodating portion 56.

Since opening and closing member 60 is pushed into accommodating portion 56, biasing portion 61 contracts in the right-left direction in the figure. Biasing portion 61 serves to exert a force upon opening and closing member 60 in such a direction that opening and closing member 60 is moved from the inside to the outside of accommodating portion 56. Biasing portion 61 is a spring, for example. Biasing portion 61 is a coil spring, for example.

In the state where pressing portion 31*p* of medicine container 31 and portion to be pressed 60*p* of opening and closing member 60 are in contact with each other, opening and closing member 60 is moved. Inlet opening 32*a* of medicine passage 32P is covered by a part of opening and closing member 60 and a part of medicine container 31.

FIG. 8 is the third partial cross-sectional view showing the state where medicine container 31 is attached to container support portion 32. Medicine container 31 shown in FIG. 8 is further moved in radial direction R as compared with FIG. 7, and disposed at the position adjacent to rear wall 32W of container support portion 32. Medicine containers 31 are arranged side by side in axial direction Z. Each of medicine containers 31 is arranged between container support portions 32 located thereabove and therebelow. The most part of each opening and closing member 60 shown in FIG. 8 is located inside accommodating portion 56. Each opening and closing member 60 shown in FIG. 8 is located at the open position where it does not cover medicine passage 32P.

Medicine container 31 that is being attached to container support portion 32 comes in contact with opening and closing member 60 to exert a force upon opening and closing member 60 in the direction from the close position to the open position. Medicine container 31 that is being attached to container support portion 32 moves opening and closing member 60 linearly from the close position to the open position. In this way, as medicine container 31 is attached to container support portion 32, medicine passage 32P is opened.

Opening and closing member 60 at the open position is located outside axial passage 51. Opening and closing member 60 at the open position is located at the position where this opening and closing member 60 does not interfere with the passage through which the medicine is discharged from medicine container 31. Accordingly, opening and closing member 60 at the open position does not prevent supply (dispensing) of medicine M using medicine supply apparatus 1.

The length of biasing portion 61 is shortest in FIG. 8, in which state biasing portion 61 exerts the maximum elastic force upon opening and closing member 60. The spring constant of biasing portion 61 is specified such that opening and closing member 60 can be reliably moved. In the present embodiment, the spring constant of biasing portion 61 is specified such that medicine container 31 can be moved against the maximum static frictional force of this medicine container 31 in the opposite direction to the direction in which medicine container 31 is attached.

When medicine container 31 is not reliably attached to container support portion 32, biasing portion 61 can move medicine container 31 in the above-mentioned opposite direction. Thus, medicine container 31 is to protrude from container support portion 32 in the above-mentioned opposite direction. Thereby, the operator can readily determine that attachment of medicine container 31 is failed.

When medicine container 31 is reliably attached to container support portion 32, medicine container 31 is locked by the lock mechanism. Accordingly, medicine container 31 is prevented from moving in the above-mentioned opposite direction, so that medicine container 31 is prevented from protruding from container support portion 32 in the above-mentioned opposite direction.

Referring to FIGS. 6, 7 and 8 in this order, the operation of medicine container 31 and opening and closing member 60 for attaching medicine container 31 to container support portion 32 is illustrated. On the other hand, referring to FIGS. 8, 7 and 6 in this order, the operation of medicine container 31 and opening and closing member 60 for detaching medicine container 31 from container support portion 32 is illustrated.

Specifically, in FIG. 8, medicine container 31 is attached to container support portion 32, and opening and closing member 60 is located at the open position where medicine passage 32P is opened. From this state, medicine container 31 is moved in radial direction R so to be directed away from rear wall 32W of container support portion 32. Biasing portion 61 exerts a biasing force upon opening and closing member 60 so as to move opening and closing member 60 in the direction from the inside to the outside of accommodating portion 56. As medicine container 31 is moved, opening and closing member 60 having received the elastic force exerted by biasing portion 61 is pushed out from accommodating portion 56. Thus, as shown in FIG. 7, opening and closing member 60 is moved to the position at which a part of opening and closing member 60 protrudes to the outside of accommodating portion 56 so as to cover inlet opening 32*a* of medicine passage 32P.

Then, medicine container 31 is further moved to the position shown in FIG. 6 at which pressing portion 31*p* of medicine container 31 is spaced apart from portion to be pressed 60*p* of opening and closing member 60. As medicine container 31 is moved in this way, opening and closing member 60 having received a force from biasing portion 61 is moved to the close position at which medicine passage 32P is closed, as shown in FIG. 6. In this way, as medicine container 31 is detached from container support portion 32, opening and closing member 60 is moved from the open position to the close position, so that medicine passage 32P is closed by opening and closing member 60. Biasing portion 61 exerts a biasing force upon opening and closing member 60 so as to move opening and closing member 60 in the direction from the open position to the close position.

Figure 9:
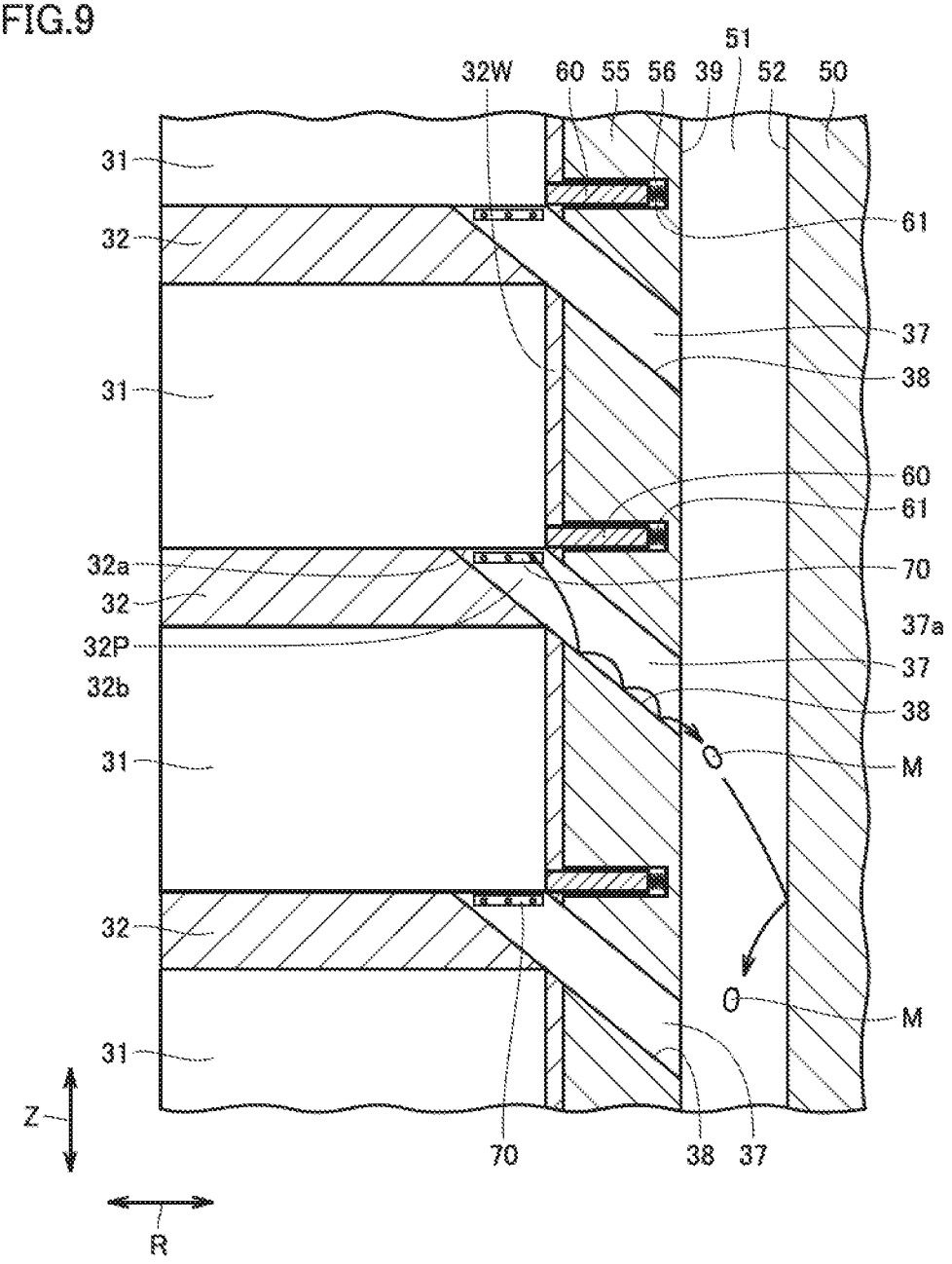
FIG. 9 is a partial cross-sectional view showing a medicine that passes through a medicine passage.

FIG. 9 is a partial cross-sectional view showing a medicine M that passes through radial passage 37 and axial passage 51. Radial passage 37 and axial passage 51 constitute a passage through which medicine M discharged from medicine container 31 passes. As shown in FIG. 9, medicine M discharged from medicine container 31 moves through inlet opening 32*a* of medicine passage 32P into radial passage 37 formed of medicine passage 32P, and passes through radial passage 37. Then, the medicine falls through axial passage 51 and is dispensed into medicine wrapping paper or a vial.

Medicine M passing through radial passage 37 moves along inclined surface 38 that forms the bottom surface of radial passage 37. Medicine M passing through radial passage 37 moves so as to slide down along inclined surface 38 or roll down along inclined surface 38.

Due to the momentum of medicine M falling down through radial passage 37, this medicine M having moved from radial passage 37 to axial passage 51 has a component of velocity from inner circumferential surface 39 toward opposed surface 52. As shown in FIG. 6, some medicines M reach opposed surface 52. Medicine M having reached opposed surface 52 collides with opposed surface 52, and bounces off opposed surface 52 so as to move away from opposed surface 52 and closer to inner circumferential surface 39 while it falls down through axial passage 51.

A detection portion 70 configured to detect medicine M passing through medicine passage 32P is disposed inside radial passage 37 formed of medicine passage 32P. Detection portion 70 is attached to the wall surface of radial passage 37, more specifically, to the wall surface in the vicinity of inlet opening 32*a* of medicine passage 32P. Detection portion 70 serves as a sensor configured to optically detect medicine M discharged from medicine container 31. Detection portion 70 may be attached to the ceiling surface that faces inclined surface 38 of radial passage 37.

The following is a summarized explanation about the configuration and the functions and effects of medicine supply apparatus 1 in the present embodiment. It is to be noted that the components in the embodiments are designated by reference numerals, which are however presented merely by way of example.

Medicine supply apparatus 1 in the present embodiment includes container support portion 32 configured to support medicine container 31 so as to be attachable and detachable as shown in FIGS. 5 to 9. Container support portion 32 is provided with medicine passage 32P through which medicine M discharged from medicine container 31 passes. Container support portion 32 has opening and closing member 60. Opening and closing member 60 is movable to: the open position shown in FIG. 8 at which medicine passage 32P is opened: and the close position shown in FIG. 6 at which medicine passage 32P is closed.

Unlike the conventional medicine supply apparatus including a cover member provided separately from the container support portion, container support portion 32 is configured to have opening and closing member 60. This eliminates the need to perform the manual operation of detaching the cover member for opening the medicine passage, or the manual operation of attaching the cover member for closing the medicine passage. Also, when the detached cover member is to be attached again, there is no need to waste time and effort for searching for the detached cover member.

When medicine container 31 is detached from container support portion 32, opening and closing member 60 is moved from the open position to the close position. Thereby, medicine passage 32P can be reliably closed, so that entry of foreign substances into medicine passage 32P can be suppressed. When medicine container 31 is attached to container support portion 32, opening and closing member 60 is moved from the close position to the open position. Thereby, medicine passage 32P can be reliably opened, so that the passage for medicine M discharged from medicine container 31 can be ensured. When the operation of attaching or detaching medicine container 31 is performed, medicine passage 32P can be readily opened or closed, so that the time and effort associated with the attachment or detachment operation can be reduced.

The configuration for opening or closing medicine passage 32P can be implemented in a simple structure. Thus, an increase in manufacturing cost of medicine supply apparatus 1 including a large number of medicine containers 31 and container support portions 32 can be suppressed. It is suitable that the time and effort required in the operation of attaching or detaching medicine container 31 can be reduced when a large number of medicine containers 31 are sequentially attached or detached.

Also as shown in FIGS. 6 to 8, medicine container 31 that is being attached to container support portion 32 moves opening and closing member 60 from the close position to the open position. Since medicine passage 32P is opened only by the operation of attaching medicine container 31 to container support portion 32, the operator who handles medicine supply apparatus 1 does not need to manually move opening and closing member 60. Accordingly, the time and effort associated with the operation of attaching medicine container 31 to container support portion 32 can be further reduced.

Also, as shown in FIGS. 6 and 7, medicine container 31 has pressing portion 31*p*, and opening and closing member 60 has portion to be pressed 60*p*. When medicine container 31 is attached to container support portion 32, portion to be pressed 60*p* comes in contact with pressing portion 31*p*, and receives the force in the direction from the close position to the open position. In this way, as medicine container 31 is attached to container support portion 32, opening and closing member 60 can be reliably moved to thereby open medicine passage 32P.

Also as shown in FIGS. 6 to 8, as medicine container 31 is detached from container support portion 32, opening and closing member 60 is moved from the open position to the close position. Since medicine passage 32P is closed only by the operation of detaching medicine container 31 from container support portion 32, the operator who handles medicine supply apparatus 1 does not need to manually move opening and closing member 60. Accordingly, the time and effort associated with the operation of detaching medicine container 31 from container support portion 32 can be further reduced.

Also as shown in FIGS. 6 to 8, medicine supply apparatus 1 further includes biasing portion 61 configured to exert a biasing force upon opening and closing member 60 so as to move opening and closing member 60 in the direction from the open position to the close position. In this way, as medicine container 31 is detached from container support portion 32, opening and closing member 60 can be reliably moved to thereby close medicine passage 32P.

Also as shown in FIGS. 6 to 8, the direction in which medicine container 31 is attached to and detached from container support portion 32 is in parallel to the direction in which opening and closing member 60 moves between the open position and the close position. In this way, opening and closing member 60 can be implemented in a simple structure. Furthermore, accommodating portion 56 accommodating opening and closing member 60 located at the open position also can be reduced in volume, so that the apparatus can be reduced in size.

Also as shown in FIG. 9, medicine supply apparatus 1 further includes detection portion 70 configured to optically detect medicine M that passes through medicine passage 32P. Opening and closing member 60 is opaque. In this way, opening and closing member 60 is disposed at the close position, so that the inside of medicine passage 32P is shielded by opening and closing member 60. Thereby, an erroneous operation of detection portion 70 can be suppressed, so that the accuracy of detecting medicine M by detection portion 70 can be improved. Thus, the number of medicines M discharged from medicine container 31 can be accurately counted.

Second Embodiment

Figure 10:
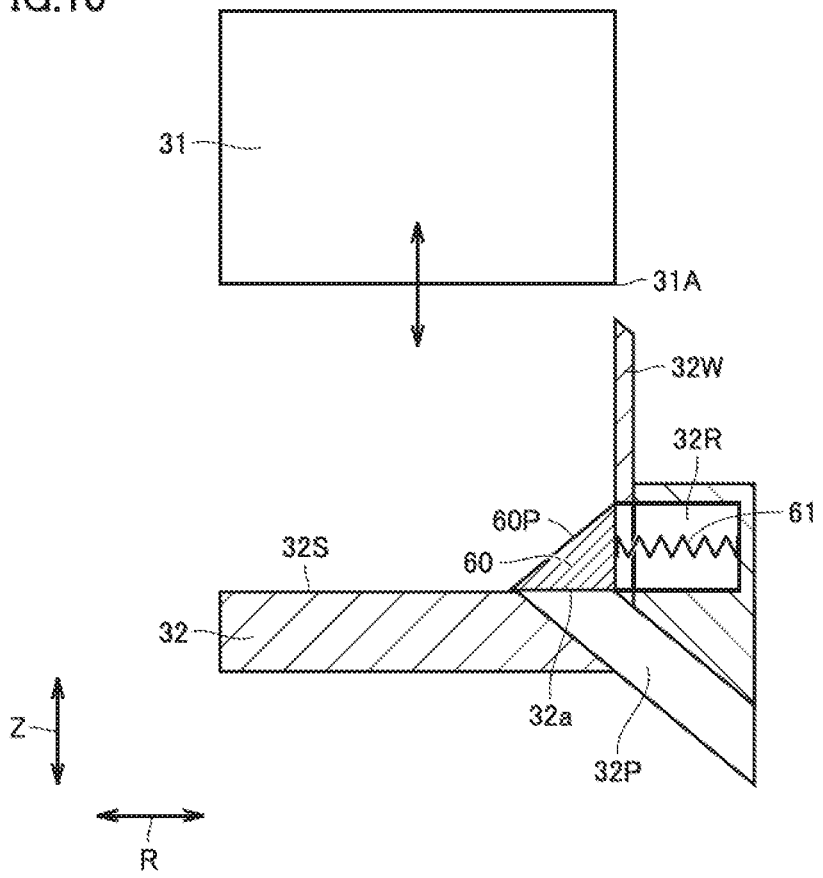
FIG. 10 is the first partial cross-sectional view showing the state where a medicine container is attached to a container support portion in the second embodiment.
Figure 11:
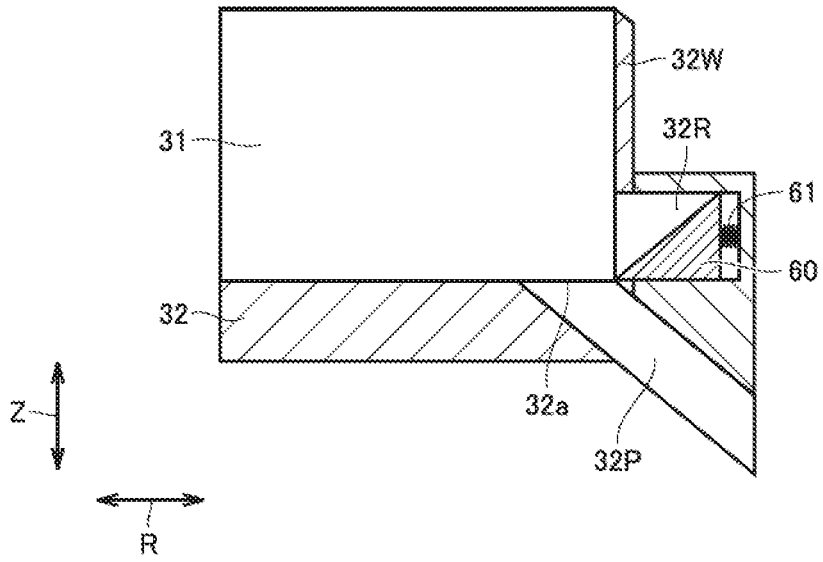
FIG. 11 is the second partial cross-sectional view showing the state where the medicine container is attached to the container support portion in the second embodiment.

FIG. 10 is the first partial cross-sectional view showing the state where medicine container 31 is attached to container support portion 32 in the second embodiment. FIG. 11 is the second partial cross-sectional view showing the state where medicine container 31 is attached to container support portion 32 in the second embodiment. In the first embodiment, an explanation has been given with regard to an example wherein the direction in which medicine container 31 is attached to and detached from container support portion 32 extends in radial direction R, the direction in which opening and closing member 60 moves between the open position and the close position also extends in radial direction R, and these two directions extend in parallel to each other, without being limited thereto.

As shown in FIGS. 10 and 11, opening and closing member 60 in the second embodiment has a right-angled triangular cross section. Portion to be pressed 60*p* of opening and closing member 60 is a flat surface that extends in the oblique direction so as to be inclined relative to support surface 32S of container support portion 32 and inclined relative to rear wall 32W. Behind rear wall 32W, container support portion 32 in the second embodiment is provided with an accommodating space 32R in which opening and closing member 60 at the open position can be accommodated.

Medicine container 31 has a contact edge 31A. Medicine container 31 moves in the direction that is orthogonal to support surface 32S of container support portion 32, as shown by a double-headed arrow in FIG. 10. When medicine container 31 located at the position shown in FIG. 10 moves in the direction approaching support surface 32S, contact edge 31A comes in contact with portion to be pressed 60*p*. When medicine container 31 further moves in the direction approaching support surface 32S, contact edge 31A slides relative to portion to be pressed 60*p*. At this time, opening and closing member 60 moves from the close position shown in FIG. 10 toward the open position shown in FIG. 11. In the state where medicine container 31 is placed on support surface 32S as shown in FIG. 11, the most part of opening and closing member 60 is accommodated in accommodating space 32R, so that medicine passage 32P is opened.

Medicine container 31 is configured to move in axial direction Z. Opening and closing member 60 is configured to move in radial direction R. The direction in which medicine container 31 is attached to and detached from container support portion 32 may be not in parallel to the direction in which opening and closing member 60 moves between the open position and the close position. The direction in which medicine container 31 is attached to and detached from container support portion 32 may be orthogonal to the direction in which opening and closing member 60 moves between the open position and the close position, as shown in FIGS. 10 and 11.

In place of the configurations in the first and second embodiments in which opening and closing member 60 linearly moves, opening and closing member 60 may be configured to move in a curved manner, or opening and closing member 60 may be configured to move along the path formed by combining a straight line and a curved line. Opening and closing member 60 may be configured to be deformed when this opening and closing member 60 moves from the open position to the close position.

Third Embodiment

Figure 12:
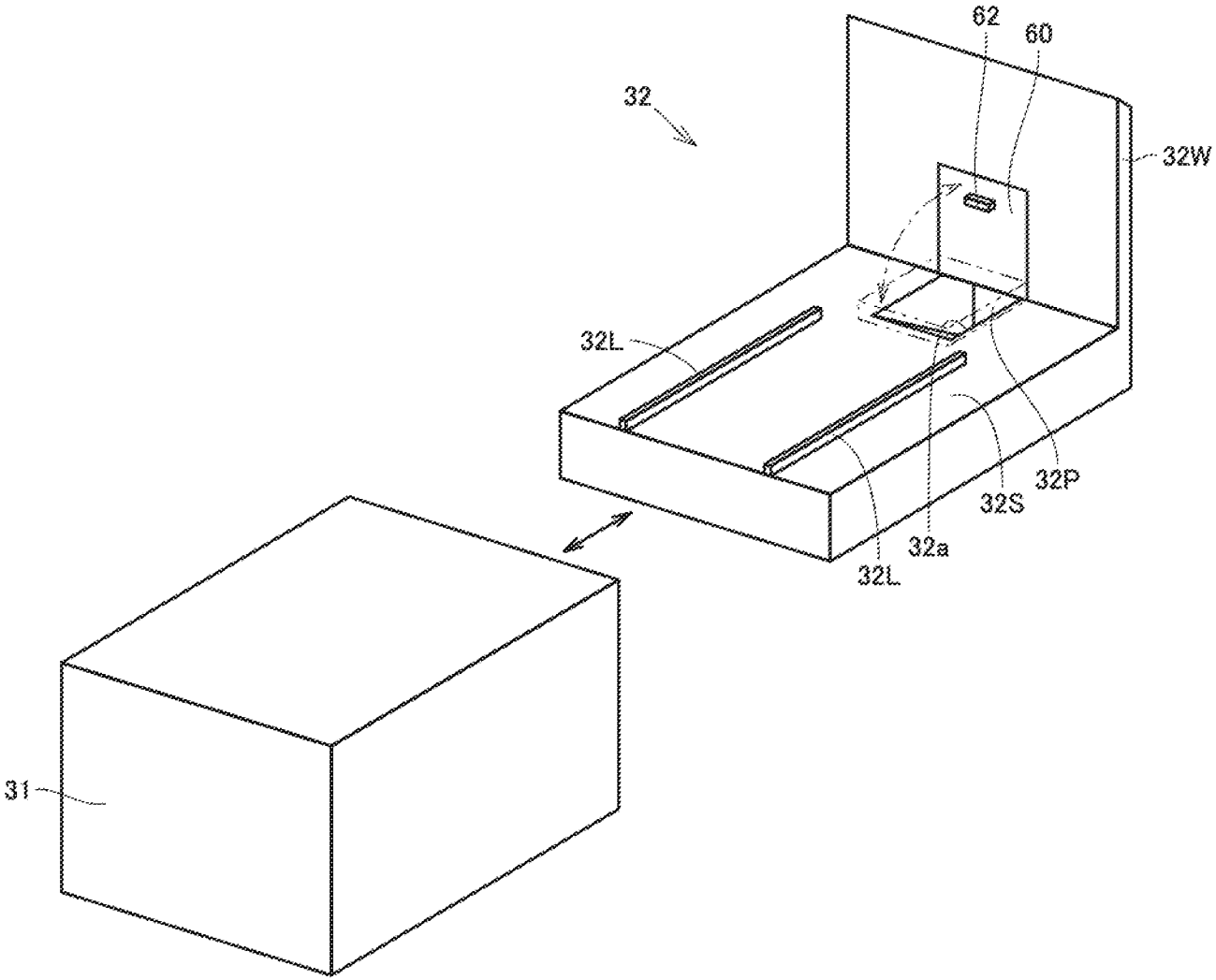
FIG. 12 is an exploded perspective view of a medicine container and a container support portion in the third embodiment.

FIG. 12 is an exploded perspective view of a medicine container 31 and a container support portion 32 in the third embodiment. In the first and second embodiments, an explanation has been given with regard to an example in which opening and closing member 60 moves from the close position to the open position as medicine container 31 is attached to container support portion 32, and opening and closing member 60 moves from the open position to the close position as medicine container 31 is detached from container support portion 32. Without being limited to the above example, opening and closing member 60 may have any configuration as long as it is movable to the open position at which medicine passage 32P is opened and to the close position at which medicine passage 32P is closed.

Opening and closing member 60 shown in FIG. 12 is movable to: the position at which opening and closing member 60 is embedded in rear wall 32W shown by a solid line; and the position at which opening and closing member 60 is disposed on support surface 32S shown by an alternate long and two short dashes line. Opening and closing member 60 is pivotable in both directions around one edge of opening and closing member 60 along support surface 32S of container support portion 32, as shown by a double-headed arrow of an alternate long and two short dashes line in FIG. 12.

Opening and closing member 60 is manually moved by the operator who handles medicine supply apparatus 1. Opening and closing member 60 is provided with a finger hook portion 62. The operator hooks his/her fingers on finger hook portion 62 and pulls opening and closing member 60 out from rear wall 32W so as to move opening and closing member 60 to the close position at which inlet opening 32*a* of medicine passage 32P is covered. The operator also picks up opening and closing member 60 located at the close position with his/her fingers, and pushes opening and closing member 60 into rear wall 32W so as to move opening and closing member 60 to the open position at which inlet opening 32*a* of medicine passage 32P is opened.

Also in the third embodiment, the direction in which medicine container 31 is attached to and detached from container support portion 32 is not in parallel to the direction in which opening and closing member 60 moves between the open position and the close position.

According to medicine supply apparatus 1 in the third embodiment, container support portion 32 is configured to have opening and closing member 60. This accordingly eliminates the need to perform the manual operation of detaching the cover member for opening the medicine passage or attaching the cover member for closing the medicine passage. Also, there is no need to waste time and effort for searching for the detached cover member when the detached cover member is to be attached again. Thus, the time and effort associated with the operation of attaching and detaching medicine container 31 can be reduced.

Although the embodiments of the present invention have been described as above, the configurations in respective embodiments may be combined as appropriate. It should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

REFERENCE SIGNS LIST

1 medicine supply apparatus,
2 housing,
20 drum,
30 arc-shaped divided body,
31 medicine container,
31A contact edge,
31*p* pressing portion,
32 container support portion,
32L rail,
32P medicine passage,
32R accommodating space,
32S support surface,
32W rear wall,
32*a* inlet opening,
37 radial passage,
38 inclined surface,
39 inner circumferential surface,
51 axial passage,
52 opposed surface,
55 inner circumferential portion,
56 accommodating portion,
60 opening and closing member,
60*p* portion to be pressed,
61 biasing portion,
62 finger hook portion,
70 detection portion,
M medicine.

The invention claimed is:

1. A medicine supply apparatus comprising:

a medicine container configured to contain a medicine; and a container support portion configured to support the medicine container so as to be attachable and detachable, the container support portion being provided with a medicine passage through which the medicine discharged from the medicine container passes, the container support portion including an opening and closing member that is movable to: an open position at which the medicine passage is opened; and a close position at which the medicine passage is closed, wherein the medicine container to be attached to the container support portion is configured to move the opening and closing member from the close position to the open position.

2. The medicine supply apparatus according to claim 1, wherein a direction in which the medicine container is attached to and detached from the container support portion is in parallel to a direction in which the opening and closing member moves between the open position and the close position.

3. The medicine supply apparatus according to claim 1, further comprising a detection portion configured to optically detect the medicine that passes through the medicine passage, wherein the opening and closing member is opaque.

4. The medicine supply apparatus according to claim 1, wherein the medicine container has a pressing portion, and the opening and closing member has a portion to be pressed, and when the medicine container is attached to the container support portion, the portion to be pressed comes in contact with the pressing portion and receives a force in a direction from the close position to the open position.

5. The medicine supply apparatus according to claim 1, wherein, as the medicine container is detached from the container support portion, the opening and closing member moves from the open position to the close position.

6. The medicine supply apparatus according to claim 5, further comprising a biasing portion configured to exert a biasing force upon the opening and closing member so as to move the opening and closing member in a direction from the open position to the close position.

* * * * *